US009765276B2

(12) United States Patent
Patel et al.

(10) Patent No.: US 9,765,276 B2
(45) **Date of Patent: *Sep. 19, 2017**

(54) ADDITIVE FOR LUBRICANT COMPOSITIONS COMPRISING A SULFUR-CONTAINING AND A SULFUR-FREE ORGANOMOLYBDENUM COMPOUND, AND A TRIAZOLE OR A DERIVATIZED TRIAZOLE

(71) Applicant: VANDERBILT CHEMICALS, LLC, Norwalk, CT (US)

(72) Inventors: Mihir K. Patel, Norwalk, CT (US); Vincent J. Gatto, Bradenton, FL (US)

(73) Assignee: VANDERBILT CHEMICALS, LLC, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/226,305

(22) Filed: Aug. 2, 2016

(65) Prior Publication Data

US 2017/0044456 A1 Feb. 16, 2017

Related U.S. Application Data

(60) Provisional application No. 62/205,240, filed on Aug. 14, 2015, provisional application No. 62/205,250, filed on Aug. 14, 2015.

(51) Int. Cl.

| | |
|---|---|
| ***C10M 133/44*** | (2006.01) |
| ***C10M 137/10*** | (2006.01) |
| ***C10M 141/12*** | (2006.01) |
| ***C10M 141/06*** | (2006.01) |
| ***C10M 163/00*** | (2006.01) |

(52) U.S. Cl.

CPC ..... *C10M 141/12* (2013.01); *C10M 141/06* (2013.01); *C10M 163/00* (2013.01); *C10M 2215/064* (2013.01); *C10M 2215/223* (2013.01); *C10M 2215/30* (2013.01); *C10M 2219/068* (2013.01); *C10M 2227/066* (2013.01); *C10M 2227/09* (2013.01); *C10N 2210/06* (2013.01); *C10N 2230/06* (2013.01); *C10N 2230/12* (2013.01); *C10N 2230/36* (2013.01); *C10N 2240/102* (2013.01); *C10N 2270/02* (2013.01)

(58) Field of Classification Search

CPC ..... C10M 2215/22; C10N 2210/02
USPC ..... 508/279, 369
See application file for complete search history.

(56) References Cited

U.S. PATENT DOCUMENTS

| | | | |
|---|---|---|---|
| 4,734,209 | A | 3/1988 | Phillips et al. |
| 5,580,482 | A | 12/1996 | Chasan et al. |
| 6,184,262 | B1 | 2/2001 | Suhoza et al. |
| 2004/0038835 | A1 | 2/2004 | Chasan et al. |
| 2008/0200357 | A1 | 8/2008 | Chasan et al. |
| 2010/0173808 | A1 | 7/2010 | Chasan et al. |
| 2011/0237474 | A1 | 9/2011 | Mazzamaro et al. |

OTHER PUBLICATIONS

International Search Report dated Sep. 24, 2016, dated Oct. 26, 2016.

*Primary Examiner* — Vishal Vasisth
(74) *Attorney, Agent, or Firm* — Norris McLaughlin & Marcus P.C.

(57) ABSTRACT

A lubricating composition for use in heavy duty diesel engines which is formulated to allow the use of organomolybdenum compounds but which overcomes the issue of Cu and/or Pb corrosion. The lubricant is characterized by having a synergistic additive composition comprising (A) a sulfur-free organo-molybdenum compound, (B) a sulfur-containing organo-molybdenum compound and (C) a triazole derivative prepared by reacting 1,2,4-triazole, a formaldehyde source and an amine; (A), (B) and (C) being present in an amount sufficient to allow the lubricating composition to pass the High Temperature Corrosion Bench Test ASTM D 6594 with respect to Cu and/or Pb corrosion.

13 Claims, No Drawings

ADDITIVE FOR LUBRICANT COMPOSITIONS COMPRISING A SULFUR-CONTAINING AND A SULFUR-FREE ORGANOMOLYBDENUM COMPOUND, AND A TRIAZOLE OR A DERIVATIZED TRIAZOLE

This application claims benefit of 62/205,240, filed Aug. 14, 2015 and claims benefit of 62/205,250, filed Aug. 14, 2015.

DESCRIPTION OF INVENTION

The invention describes a new composition that is effective at reducing the Cu and Pb corrosion of engine oils containing high levels of organo-molybdenum compounds. The invention also describes new engine oil compositions containing high levels of molybdenum that are resistant to Cu and Pb corrosion. The invention also describes a method of reducing Cu and Pb corrosion in engine oils formulated with high levels of organomolybdenum compounds.

The composition comprises (A) a sulfur-containing organo-molybdenum compound, (B) a sulfur-free organo-molybdenum compound, and (C) triazole or a derivatized triazole.

The new engine oil compositions comprise: (A) a sulfur-containing organo-molybdenum compound, (B) a sulfur-free organo-molybdenum compound, (C) triazole or a derivatized triazole, (D) one or more base oils, and, optionally, (E) one or more additives selected from the group including antioxidants, dispersants, detergents, anti-wear additives, extreme pressure additives, friction modifiers, rust inhibitors, corrosion inhibitors, seal swell agents, anti-foaming agents, pour point depressants and viscosity index modifiers.

The method of reducing Cu and Pb corrosion involves adding the above composition, either as a blend, as individual components or as a blend or individual components in combination with the optional additives described in (E), to a lubricating engine oil that is determined to be corrosive to Cu and/or Pb as determined by the High Temperature Corrosion Bench Test ASTM D 6594 when at least one of A, B or C are not present. An oil corrosive to Cu is one that reports an end of test used oil Cu level increase above the 20 ppm maximum for the heavy duty diesel CJ-4 specification. An oil corrosive to Pb is one that reports an end of test used oil Pb level increase above the 120 ppm maximum for the heavy duty diesel CJ-4 specification.

DESCRIPTION OF PRIOR ART

U.S. Application 20100173808 and 20080200357 describe the use of derivatized triazoles, but molybdenum is not present or mentioned. U.S. Application 20040038835 describes derivatized triazoles but does not teach the use of combinations of molybdenum compounds. U.S. Pat. No. 5,580,482 describes derivatized triazoles used in triglyceride ester oils but molybdenum is not mentioned or present.

SUMMARY OF THE INVENTION

It is known that the use of organo-molybdenum compounds in lubricants provides a number of beneficial properties including oxidation protection, wear protection and friction reduction for improved fuel economy performance. There are generally two classes of molybdenum compounds that are utilized to achieve these benefits. They are the sulfur-containing organo-molybdenum compounds, of which the molybdenum dithiocarbamates and tri-nuclear organo-molybdenum compounds are the best known, and the sulfur-free organo-molybdenum compounds of which the organo-molybdate esters and molybdenum carboxylates are the best known. These products provide valuable benefits to lubricants but also have limitations. The main limitation is that they tend to be corrosive to Cu and Pb in engine oils, primarily heavy duty diesel engine oils. Corrosion for diesel engine oils is determined using the High Temperature Corrosion Bench Test ASTM D 6594. Oils will fail for Cu corrosion if the after test used oil has a Cu level increase that exceeds 20 ppm. Oils will fail for Pb corrosion if the end of test used oil has a Pb level increase that exceeds 120 ppm. This corrosion issue has limited the level of organo-molybdenum compounds that can be used in lubricants, especially heavy duty diesel engine oils. Based on the type of molybdenum compound selected, either Cu, Pb, or both may be problematic for corrosion. Thus, very low levels of organo-molybdenum compounds, and sometimes none at all, are used in certain heavy duty diesel engine oil formulations in order to pass the ASTM D 6594. This tends to be a major limitation in formulating crankcase engine oils, especially heavy duty diesel engine oils, since molybdenum compounds can be quite valuable for improving the other properties stated above. Thus, a need exists for reducing the Cu and Pb corrosion of organo-molybdenum compounds when used in engine oil, and especially heavy duty diesel engine oil formulations. Specifically, a need exists to pass the High Temperature Corrosion Bench Test ASTM D 6594 for Cu and Pb corrosion in engine oil formulations containing organo-molybdenum compounds. This invention provides compositions and methods of achieving these goals.

Even small improvements in Cu and Pb corrosion protection in the presence of organo-molybdenum compounds would prove of significant value in advanced engine oil formulations. For example, even the ability to increase the level of molybdenum from 0-25 ppm to 75-200 ppm in a finished heavy duty diesel engine oil formulation would allow the use of molybdenum to better control oxidation and wear protection.

This invention allows the use of significantly higher levels of organo-molybdenum compounds (at least up to 320 ppm, and possibly up to 800 ppm) in engine oil formulations that are required to pass the High Temperature Corrosion Bench Test ASTM D 6594. In addition, corrosivity of engine oil formulations were also evaluated by modifying the temperature and test duration used in ASTM D 6594 where a higher temperature and shorter test duration compared to ASTM D 6594 were used. These include primarily heavy duty diesel engine oils. However, the invention should have utility in any engine oil formulation where Cu and Pb corrosion can be a problem. Other examples include passenger car engine oils, marine diesel oils, railroad diesel oils, natural gas engine oils, racing oils, hybrid engine oils, turbo-charged gasoline and diesel engine oils, engine oils used in engines equipped with direct injection technology, and two- and four-cycle internal combustion engines.

U.S. Application 20040038835 describes derivatized triazoles and teaches their use with either sulfur-containing or sulfur-free organo-molybdenum compounds, but does not teach the combination of both sulfur-free and sulfur-containing organo-molybdenum compounds as being critical to achieving both Cu and Pb corrosion protection, and further does not teach the use of these compounds to reduce copper corrosion. Only reduction of Pb corrosion is taught.

This invention will provide the ability to use higher levels of organomolybdenum in heavy duty diesel engine oils to solve a variety of possible performance problems including improved oxidation control, improved deposit control, better wear protection, friction reduction and improvements in fuel economy and overall lubricant robustness and durability.

This invention may represent a very cost effective way to provide a small increase in molybdenum content of heavy duty diesel engine oils. Most heavy duty diesel oils today do not contain molybdenum, or if they do at very low levels (less than 50 ppm). This invention could allow the use of 50 to 800 ppm, preferably 75-320 ppm of molybdenum in a very cost effective way. Higher levels of molybdenum are possible with this technology but at a higher cost.

Component A—Sulfur-Containing Organo-Molybdenum Compounds

The sulfur-containing organo-molybdenum compound may be mono-, di-, tri- or tetra-nuclear as described in U.S. Pat. No. 6,723,685. Dinuclear and trinuclear sulfur-containing organo-molybdenum compounds are preferred. More preferably, the sulfur-containing organo-molybdenum compound is selected from the group consisting of molybdenum dithiocarbamates (MoDTC), molybdenum dithiophosphates (MoDTP), molybdenum dithiophosphinates, molybdenum xanthates, molybdenum thioxanthates, molybdenum sulfides and mixtures thereof.

The sulfur-containing organo-molybdenum compounds that may be used include tri-nuclear molybdenum-sulfur compounds as described in European Patent Specification EP 1 040 115 and U.S. Pat. No. 6,232,276, molybdenum dithiocarbamates as described in U.S. Pat. Nos. 4,098,705, 4,178,258, 5,627,146, and U.S. Patent Application 20120264666, sulfurized oxymolybdenum dithiocarbamates as described in U.S. Pat. Nos. 3,509,051 and 6,245,725, molybdenum oxysulfide dithiocarbamates as described in U.S. Pat. Nos. 3,356,702 and 5,631,213, highly sulfurized molybdenum dithiocarbamates as described in U.S. Pat. No. 7,312,348, highly sulfurized molybdenum oxysulfide dithiocarbamates as described in U.S. Pat. No. 7,524,799, imine molybdenum dithiocarbamate complexes as described in U.S. Pat. No. 7,229,951, molybdenum dialkyl dithiophosphates as described in Japanese Patents 62039696 and 10121086 and U.S. Pat. Nos. 3,840,463, 3,925,213 and 5,763,370, sulfurized oxymolybdenum dithiophosphates as described in Japanese Patent 2001040383, oxysulfurized molybdenum dithiophosphates as described in Japanese Patents 2001262172 and 2001262173, and molybdenum phosphorodithioates as described in U.S. Pat. No. 3,446,735.

In addition, the sulfur containing organo-molybdenum compounds may be part of a lubricating oil dispersant as described in U.S. Pat. Nos. 4,239,633, 4,259,194, 4,265,773 and 4,272,387, or part of a lubricating oil detergent as described in U.S. Pat. No. 4,832,857.

Examples of commercial sulfur-containing organo-molybdenum compounds that may be used include MOLYVAN 807, MOLYVAN 822 and MOLYVAN 2000, and MOLYVAN 3000, which are manufactured by Vanderbilt Chemicals, LLC, and SAKURA-LUBE 165 and SAKURA-LUBE 515, which are manufactured by Adeka Corporation, and Infineum C9455, which is manufactured by Infineum International Ltd.

The treat level of the sulfur-containing organo-molybdenum compound in the engine oil compositions may be any level that will result in Cu and/or Pb corrosion as determined by the High Temperature Corrosion Bench Test ASTM D 6594. Actual treat levels can vary from 25 to 1000 ppm molybdenum metal and will vary based on the amount of components B and C, the engine oil additives present in the formulation and the base oil type used in the finished lubricant. Preferred levels of sulfur-containing organo-molybdenum are 50 to 500 ppm molybdenum metal and the most preferred levels are 75 to 350 ppm molybdenum metal.

Component B—Sulfur-Free Organo-Molybdenum Compounds

The sulfur-free organo-molybdenum compounds that may be used include organo-amine complexes with molybdenum as described in U.S. Pat. No. 4,692,256, glycol molybdate complexes as described in U.S. Pat. No. 3,285,942, molybdenum imide as described in U.S. Patent Application 20120077719, organo-amine and organo-polyol complexes with molybdenum as described in U.S. Pat. No. 5,143,633, sulfur-free organo-molybdenum compounds with high molybdenum content as described in U.S. Pat. Nos. 6,509,303, 6,645,921 and 6,914,037, molybdenum complexes prepared by reacting a fatty oil, diethanolamine and a molybdenum source as described in U.S. Pat. No. 4,889,647; an organomolybdenum complex prepared from fatty acids and 2-(2-aminoethyl) aminoethanol as described in U.S. Pat. No. 5,137,647, 2,4-heteroatom substituted-molybdena-3,3-dioxacycloalkanes as described in U.S. Pat. No. 5,412,130, and molybdenum carboxylates as described in U.S. Pat. Nos. 3,042,694, 3,578,690 and RE30642.

In addition, the sulfur-free organo-molybdenum compounds may be part of a lubricating oil dispersant as described in U.S. Pat. Nos. 4,176,073, 4,176,074, 4,239,633, 4,261,843, and 4,324,672, or part of a lubricating oil detergent as described in U.S. Pat. No. 4,832,857.

Examples of commercial sulfur-free organo-molybdenum compounds that may be used include MOLYVAN 855, which is manufactured by Vanderbilt Chemicals, LLC, SAKURA-LUBE 700 which is manufactured by Adeka Corporation, and 15% Molybdenum HEX-CEM, which is manufactured by OM Group Americas, Inc.

The treat level of the sulfur-free organo-molybdenum compound in the engine oil compositions may be any level that will result in Cu and/or Pb corrosion as determined by the High Temperature Corrosion Bench Test ASTM D 6594. Actual treat levels can vary from 25 to 1000 ppm molybdenum metal and will vary based on the amount of components A and C, the engine oil additives present in the formulation and the base oil type used in the finished lubricant. Preferred levels of sulfur-free organo-molybdenum are 50 to 500 ppm molybdenum metal and the most preferred levels are 75 to 350 ppm molybdenum metal.

Component C—Triazole or Derivatized Triazole

A key feature of the triazoles and derivatized triazoles is that they are not tolutriazoles or benzotriazoles, or derivatized tolutriazoles or benzotriazoles. This is an important distinction in their ability to function as effective corrosion inhibitors when in the presence of sulfur-free organo-molybdenum compounds and sulfur-containing organo-molybdenum compounds. It is believed that the derivatized triazoles of this invention are made more effective due to the absence of a fused aromatic ring.

1,2,4-Triazole may be used in this invention but is not preferred due to its volatility and poor solubility in lubricants. However, it is contemplated that 1,2,4-triazole, if solubilized and under certain application conditions, can be effective.

The derivatized triazoles are prepared from 1,2,4-triazole (triazole), a formaldehyde source and alkylated diphenylamine by means of the Mannich reaction. These reactions are described in U.S. Pat. No. 4,734,209 where the alkylated diphenylamine is replaced by various secondary amines, and in U.S. Pat. No. 6,184,262, where the triazole is replaced by benzotriazole or tolutriazole. Water is a by-product of the reaction. The reaction may be carried out in a volatile organic solvent, in a diluent oil or in the absence of a diluent. When a volatile organic solvent is used, in general the solvent is removed by distillation after the reaction is complete. A slight stoichiometric excess of either the 1,2,4-triazole, the formaldehyde source, or the alkylated diphenylamine may be used without adversely affecting the utility of the final product isolated.

The derivatized triazole may have one of three possible structures where R1 and R2 represent hydrogen, or the same or different linear or branched hydrocarbyl groups from 1 to 30 carbons, or hydrogen, or the same or different alkaryl groups from 7 to 30 carbons, or hydrogen, or the same or different aryl groups from 6 to 10 carbons, and R3 represents hydrogen, or a linear or branched alkyl group from 1 to 30 carbons.

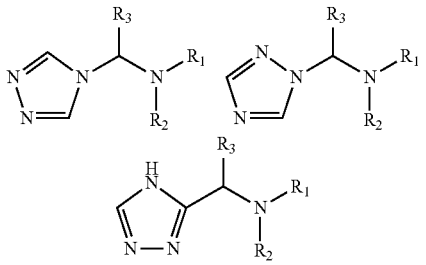

Below are other ways of possibly naming these molecules where R3 is hydrogen, and R1 and R2 are alkyl or alkylphenyl:

1H-1,2,4-triazole-1-methanamine, N,N-bis(alkyl)—
N,N-bis(alkyl)-((1,2,4-triazol-1-yl)methyl)amine
N,N-bis(alkyl)aminomethyl-1,2,4-triazole
N,N-bis(alkyl)-((1,2,4-triazole-1-yl)methyl)amine
Bis(alkyl)(1H-1,2,4-triazol-1-ylmethyl)amine
N,N-bis(alkyl)-1H[(1,2,4-triazol-1-yl)methyl]amine
N,N-bis(alkyl)-[(1,2,4-triazol-1-yl)methyl]amine
N,N-bis(alkyl)-1,2,4-triazole-1-ylmethanamine
1H-1,2,4-triazole-1-methanamine, N,N-bis(4-alkylphenyl)—
N,N-bis(4-alkylphenyl)-((1,2,4-triazol-1-yl)methyl)amine
N,N-bis(4-alkylphenyl)aminomethyl-1,2,4-triazole
N,N-bis(4-alkylphenyl)-((1,2,4-triazole-1-yl)methyl)amine
Bis(4-alkylphenyl)(1H-1,2,4-triazol-1-ylmethyl)amine
N,N-bis(4-alkylphenyl)-1H[(1,2,4-triazol-1-yl)methyl]amine
N,N-bis(4-alkylphenyl)-[(1,2,4-triazol-1-yl)methyl]amine
N,N-bis(4-alkylphenyl)-1,2,4-triazole-1-ylmethanamine Examples of triazoles that may be used include:

1-(N,N-bis(methyl)aminomethyl)-1,2,4-triazole
1H-1,2,4-Triazole-5-methanamine, N,N-bis(methyl)—
4H-1,2,4-Triazole-4-methanamine, N,N-bis(methyl)—
1-(N,N-bis(ethyl)aminomethyl)-1,2,4- triazole
1H-1,2,4-Triazole-5-methanamine, N,N-bis(ethyl)—
4H-1,2,4-Triazole-4-methanamine, N,N-bis(ethyl)—
1-(N,N-bis(n-propyl)aminomethyl)-1,2,4- triazole
1H-1,2,4-Triazole-5-methanamine, N,N-bis(n-propyl)—
4H-1,2,4-Triazole-4-methanamine, N,N-bis(n-propyl)—
1-(N,N-bis(n-butyl)aminomethyl)-1,2,4-triazole
1H-1,2,4-Triazole-5-methanamine, N,N-bis(n-butyl)—
4H-1,2,4-Triazole-4-methanamine, N,N-bis(n-butyl)—
1-(N,N-bis(n-pentyl)aminomethyl)-1,2,4- triazole
1H-1,2,4-Triazole-5-methanamine, N,N-bis(n-pentyl)—
4H-1,2,4-Triazole-4-methanamine, N,N-bis(n-pentyl)—
1-(N,N-bis(octyl)aminomethyl)-1,2,4- triazole
1H-1,2,4-Triazole-5-methanamine, N,N-bis(octyl)—
4H-1,2,4-Triazole-4-methanamine, N,N-bis(octyl)—
1-(N,N-bis(2-ethylhexyl)aminomethyl)-1,2,4-triazole
1H-1,2,4-Triazole-5-methanamine, N,N-bis(2-ethylhexyl)—
4H-1,2,4-Triazole-4-methanamine, N,N-bis(2-ethylhexyl)—
1-(N,N- bis(decyl)aminomethyl)-1,2,4-triazole
1H-1,2,4-Triazole-5-methanamine, N,N-bis(decyl)—
4H-1,2,4-Triazole-4-methanamine, N,N-bis(decyl)—
1-(N,N-bis(dodecyl)aminomethyl)-1,2,4- triazole
1H-1,2,4-Triazole-5-methanamine, N,N-bis(dodecyl)—
4H-1,2,4-Triazole-4-methanamine, N,N-bis(dodecyl)—
1-(N,N-bis(tridecyl)aminomethyl)-1,2,4- triazole
1H-1,2,4-Triazole-5-methanamine, N,N-bis(tridecyl)—
4H-1,2,4-Triazole-4-methanamine, N,N-bis(tridecyl)—
1-(N,N-bis(4- butylphenyl)aminomethyl)-1,2,4-triazole
1H-1,2,4-Triazole-5-methanamine, N,N-bis(4-butylphenyl)—
4H-1,2,4-Triazole-4-methanamine, N,N-bis(4-butylphenyl)—
1-(N,N-bis(4- octylphenyl)aminomethyl)-1,2,4-triazole
1H-1,2,4-Triazole-5-methanamine, N,N-bis(4-octylphenyl)—
4H-1,2,4-Triazole-4-methanamine, N,N-bis(4-octylphenyl)—
1-(N,N-bis(4- nonylphenyl)aminomethyl)-1,2,4-triazole
1H-1,2,4-Triazole-5-methanamine, N,N-bis(4-nonylphenyl)—
4H-1,2,4-Triazole-4-methanamine, N,N-bis(4-nonylphenyl)—
1-(N,N- bis(phenyl)aminomethyl)-1,2,4-triazole
1H-1,2,4-Triazole-5-methanamine, N,N-bis(phenyl)—
4H-1,2,4-Triazole-4-methanamine, N,N-bis(phenyl)—

The derivatized triazole may be a bis-triazole as shown below:

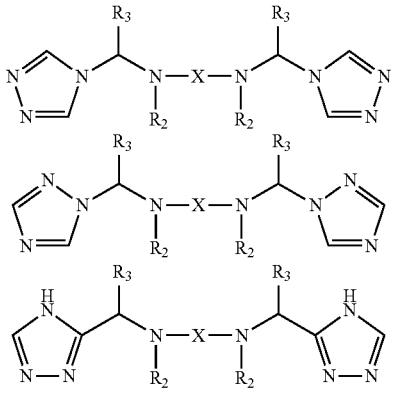

Where X may be a linear or branched hydrocarbyl group from 1 to 30 carbons, or a polyalkylene glycol group —$(CH_2CH_2O)yCH_2CH_2$—, where y can vary from 1 to 250.

The derivatized triazoles that may be used are disclosed in U.S. Pat. Nos. 4,734,209, 5,580,482 and U.S. Patent Applications 20040038835, 20080127550, 20080139425, 20080200357, 20100173808 and Canadian Patent Application 2105132.

In addition, the derivatized triazole may be part of a lubricating oil dispersant as described in U.S. Pat. Nos. 4,908,145, 5,049,293, 5,080,815 and 5,362,411.

Preferred derivatized triazoles are the alkylated diphenylamine derivatives of triazoles described in U.S. provisional application Ser. No. 62/205,250 filed Aug. 14, 2016 by the present applicant.

Particularly preferred are alkylated diphenylamine derivatives of triazole, being octylated or higher alkylated diphenylamine derivatives of triazole (e.g. nonylated, decylated, undecylated, dodecylated, tridecylated, tetradecylated, pentadecylated, hexadecylated). The alkyl groups may be linear, branched or cyclic in nature. Preferably, the novel molecule is 1-[di-(4-octylphenyl)aminomethyl]triazole or 1-[di-(4-nonylphenyl)aminomethyl]triazole. However, it is expected that a molecule which has at least one phenyl group being octylated or higher alkyl, where the other phenyl group may be alkylated with C7 or lower, such as C4, would also be effective. For example, also contemplated is a mixture of molecules described as 1-[di-(4-mixed butyl/octylphenyl) aminomethyl]triazole, which comprises a mixture of 1-[(4-butylphenyl) (phenyl) aminomethyl]triazole, 1-[(4-octylphenyl) (phenyl) aminomethyl]triazole, 1-[di-(4-butylphenyl)aminomethyl]triazole, 1-[di-(4-octylphenyl) aminomethyl]triazole, and 1-[(4-butylphenyl) (4-octylphenyl) aminomethyl]triazole. In cases where the molecule or mixture of molecules is present in a lubricating composition, it may be that the effective amount of the mixture of molecules would be based on the proportion of the octylated or higher alkyl which is present.

The treat level of the derivatized triazole in the engine oil compositions may be any level necessary to reduce Cu and Pb corrosion, or any level necessary to pass the High Temperature Corrosion Bench Test ASTM D 6594 for Cu and Pb when components A and B by themselves fail. A practical range is from 0.01 wt % to 0.25 wt %. However, in applications where exceedingly high levels of A and B are employed (e.g. 1000 ppm A and 1000 ppm B) a higher level of derivatized triazole may be necessary. Conversely, in applications where very low levels of A and B are employed (e.g. 50 ppm A and 50 ppm B), levels of derivatized triazole well below 0.01 wt % (e.g. 0.001 wt %) may be effective.

In this novel three component system it is understood that actual treat levels for each of the three components is dependent upon the treat levels of the remaining components, the base oil types being used and the overall additive system being utilized in the finished lubricant.

Component D—Base Oils

Mineral and synthetic base oils may be used including any of the base oils that meet the API category for Group I, II, III, IV and V.

Component E—Additional Additives

Additional additives are selected from the group including antioxidants, dispersants, detergents, anti-wear additives, extreme-pressure additives, friction modifiers, rust inhibitors, corrosion inhibitors, seal swell agents, anti-foaming agents, pour point depressants and viscosity index modifiers. One or more of each type of additive may be employed. It is preferred that the anti-wear additives contain phosphorus.

For a heavy duty diesel engine oil, the additional additives would include one or more dispersants, one or more calcium or magnesium overbased detergents, one or more antioxidants, zinc dialkyldithiophosphate as the anti-wear additive, one or more organic friction modifiers, a pour point depressant and one or more viscosity index modifiers. Optional additional additives used in heavy duty diesel engine oils include: (1) supplemental sulfur-based, phosphorus-based or sulfur- and phosphorus-based anti-wear additives. These supplemental anti-wear additives may contain ash producing metals (Zinc, Calcium, Magnesium, Tungsten, and Titanium for example) or they may be ashless, (2) supplemental antioxidants including sulfurized olefins, and sulfurized fats and oils. The following list shows representative additives that may be used in heavy duty diesel engine oil formulations in combination with the additives of this invention:

Octylated diphenylamine
Mixed butylated/octylated diphenylamine
Nonylated diphenylamine
Octylated phenyl-α-naphthylamine
Nonylated phenyl-α-naphthylamine
Dodecylated phenyl-α-naphthylamine
Methylenebis(di-n-butyldithiocarbamate)
3,5-di-tert-butyl-4-hydroxyhydrocinnamic acid, $C_{10}$-$C_{14}$ alkyl esters
3,5-di-tert-butyl-4-hydroxyhydrocinnamic acid, $C_7$-$C_9$ alkyl esters
3,5-di-tert-butyl-4-hydroxyhydrocinnamic acid, iso-octyl ester
3,5-di-tert-butyl-4-hydroxyhydrocinnamic acid, butyl ester
3,5-di-tert-butyl-hydroxyhydrocinnamic acid, methyl ester,
4,4'-methylenebis(2,6-di-tert-butylphenol)
Glycerol mono-oleate
Oleamide
Octylated diphenylamine derivative of tolutriazole
N,N'bis(2-ethylhexyl)-ar-methyl-1H-benzotriazole-1-methanamine
Dialkylammonium Tungstate
Zinc diamyldithiocarbamate
Borate ester derived from the reaction product of a fatty oil and diethanolamine butanedioic acid (4,5-dihydro-5 thioxo-1,3,4-thiadiazol-2-yl) thio-bis(2-ethylhexyl)ester
3-[[bis(1-methylethoxy)phosphinothioyl]thio]propionic acid, ethyl ester
Dialkyldithiophosphate succinates
Dialkylphosphoric acid mono alkyl primary amine salts
2,5-dimercapto-1,3,4-thiadiazole derivatives The method of reducing Cu and Pb corrosion involves adding to an engine oil that fails the High Temperature Corrosion Bench Test ASTM D 6594 for Cu and/or Pb corrosion one or more of A, B and C depending on what is already present in the formulation. For example, if an engine oil fails ASTM D 6594 and contains A and B, the method would involve adding C. If an engine oil fails ASTM D 6594 and contains A and C, the method would involve adding B. If an engine oil fails ASTM D 6594 and contains B and C, the method would involve adding A. If an engine oil fails ASTM D 6594 and contains only A, the method would involve adding B and C. If an engine oil fails ASTM D 6594 and contains only B, the method would involve adding A and C. If an engine oil fails ASTM D 6594 and contains only C, the method would involve adding A and B. The method may also involve adding a blend of A, B and C to an engine oil that fails the ASTM D 6594 when one of A, B or C are not present.

It is also contemplated that the additive combinations of this invention are effective top treats to existing heavy duty diesel engine oil formulations. For example, it may be desired to improve the antioxidant, antiwear, frictional properties or deposit control properties of an existing commercial heavy duty diesel engine oil. This would represent a performance improvement beyond what is required for commercial licensing purposes. In such a case a blend of Components A, B and C would permit the use of high levels of molybdenum for achieving higher performance attributes while still controlling Cu and Pb corrosion. Thus a method of enhancing the performance of a heavy duty diesel engine oil would involve adding to the heavy duty diesel engine oil a blend of Component A, B and C. Additionally, the invention contemplates an engine oil, particularly a heavy duty diesel engine oil, having components A, B and C present, each component being present either as part of the engine oil formulation, or as an additive.

The lubricating composition of the invention comprises a major amount of base oil (e.g. at least 80%, preferably at least 85% by weight) and an additive composition comprising:

(A) a sulfur-containing organo-molybdenum compound, (B) a sulfur-free organo-molybdenum compound, and (C) triazole or a derivatized triazole.

(A) and (B) may be present in the lubricating composition in an amount which together provides about 50-800 ppm molybdenum, preferably about 75-320 ppm molybdenum. A ratio of (A):(B) based on the amount of molybdenum provided by each may be from about 0.25:1 to 4:1, preferably about 0.5:1 to 2:1, and most preferably at about 1:1. (C) is present in the lubricating composition in an amount between 0.001 wt. % and 1.0 wt. %, preferably between 0.005 and 0.4 wt. %.

It is noted that the amount of derivatized triazole may be correlated to the total amount of molybdenum, such that at lower molybdenum amounts, less triazole is needed. For example, when (A) and (B) together provide between about 50-200 ppm molybdenum, preferably about 120 ppm Mo, (C) is present at between about 0.005-0.05 wt %. When (A) and (B) together provide between about 250-500 ppm molybdenum, preferably about 320 ppm Mo, (C) is present at between about 0.1-0.5 wt %, preferably about 0.2-0.4 wt %.

The invention also contemplates an additive concentrate for adding to a lubricating composition, the additive concentrate comprising components (A), (B) and (C) as above, wherein the ratio of (A):(B) based on the amount of molybdenum provided by each may be from about 0.25:1 to 4:1, preferably about 0.5:1 to 2:1, and most preferably at about 1:1; and the weight ratio of [the total of (A)+(B)]:(C) is from about 50:1 to 1:2, preferably about 33:1 to 1:1.

Attempts were made to try and reduce copper and lead corrosion in the High Temperature Corrosion Bench Test, ASTM D 6594, by using more traditional corrosion inhibitors such as derivatized tolutriazoles (CUVAN® 303) and 2,5 dimercapto-1,3,4-thiadiazole derivative (CUVAN® 826). The former produced very high lead corrosion and the latter produced very high copper corrosion. Switching from a derivatized tolutiazole to a derivatized triazole provided acceptable lead and copper corrosion reduction.

An exemplary product may contain a blend of MOLYVAN® 855 (sulfur-free) molybdenum ester/amide complex from Vanderbilt Chemicals, LLC, and one or more of sulfur-containing molybdenum additives such as MOLYVAN® 3000 or 822 molybdenum dithiocarbamates, MOLYVAN® L Molybdenum di (2-ethylhexyl) phosphorodithioate, all from Vanderbilt Chemicals, LLC, or Sakuralube® 525 molybdenum dithiocarbamate from Adeka Corporation; in the presence of IRGAMET® 30 (derivatized triazole 1-(di-(2-ethylhexyl)aminomethyl)-1,2,4-triazole) from BASF Corp.

It is expected that while the derivatized triazole is effective in reducing corrosion in the presence of a molybdenum-containing additive, the effect is more pronounced where the lubricating oil contains a combination of both sulfur-containing and sulfur-free molybdenum compounds.

| Blend A | Blend B |
|---|---|
| MOLYVAN 855 @ 45 wt. % | MOLYVAN 855 @ 50 wt. % |
| MOLYVAN 3000 @ 36 wt. % | MOLYVAN 3000 @ 40 wt. % |
| IRGAMET 30 @ 19 wt. % | IRGAMET 30 @ 10 wt. % |

Use of Blend A at 1.0 wt. % in a finished engine oil would deliver 360 ppm Mo from MOLYVAN 855, 360 ppm Mo from MOLYVAN 3000, and 0.19 wt. % IRGAMET 30. Use of Blend B at 0.25 wt. % in a finished engine oil would deliver 100 ppm Mo from MOLYVAN 855, 100 ppm Mo from MOLYVAN 3000, and 0.025 wt. % IRGAMET 30. It is expected that with reduced levels of Mo in the engine oil, e.g. down to 100 ppm or less, IRGAMET 30 may be effective in reducing corrosion at extremely low levels, e.g. down to 0.01 wt % or lower.

EXAMPLES

Examples 1A Thru 3C

Corrosivity of lubricants towards copper and lead metals was evaluated using the high temperature corrosion bench test (HTCBT) according to the ASTM D 6594 test method. Details of the test method can be found in the annual book of ASTM standards. For the test specimen 100±2 grams of lubricant was used. Four metal specimens of copper, lead, tin and phosphor bronze were immersed in a test lubricant. The test lubricant was kept at 135° C. and dry air was bubbled through the lubricant at 5±0.5 L/h for 1 week. API CJ-4 specifications for heavy duty diesel engine oil limits the metal concentration of copper and lead in the oxidized oil as per ASTM D 6594 test methods to 20 ppm maximum and 120 ppm maximum respectively. After the test, the lubricants were analyzed for the Cu and Pb metal content in the oil using inductive coupled plasma (ICP) analytical technique.

In Table 1, "base blend" is SAE 15W-40 viscosity grade fully formulated heavy duty diesel engine oil consisting of one or more base oils, dispersants, detergents, VI Improvers, antioxidants, antiwear agents, pour point depressants and any other additives such that when combined with the invention makes a fully formulated motor oil. Base blend is then further formulated as described in the examples 1A to 3C. The following components of the invention were evaluated: Molybdenum dithiocarbamate (A) is a commercial branched tridecyl amine based molybdenum dithiocarbamate containing 10% molybdenum by weight available from Vanderbilt Chemicals, LLC as MOLYVAN® 3000. Molybdenum Ester/Amide is a commercial molybdate ester containing 8% molybdenum by weight available from Vanderbilt Chemicals, LLC as MOLYVAN® 855. 1,2,4-Triazole (C) is 1-(N,N-bis(2-ethylhexyl)aminomethyl)-1,2,4-triazole. All the formulations in Table 1 have a total molybdenum content of 150 ppm. In examples 1A thru 1B, when only a single molybdenum source is used (either sulfur-containing molybdenum (A) or sulfur-free molybdenum (B)) and triazole C is not present, the passing rate in the HTCBT is very low (16.6% for Cu and 66.66% for Pb). In examples 2A thru 2G, when two of the three components are present (A+B, A+C or B+C), the passing rate in the HTCBT increases to 52.38% for Cu and 71.42% for Pb. However, the most striking results are obtained when all three components are present (A+B+C) as illustrated in examples 3A thru 3C. In this case a very high passing rate of 77.7% for Cu and 100% for Pb is obtained. This highlights the significant improvement in both Cu and Pb corrosion as measured in the HTCBT when a three component system containing A, B and C is present. Of even more significance is the extremely low treat levels of the 1,2,4-triazole (C) that are required in order to observe this effect. Table 1 clearly illustrates that 1,2,4-triazole (C) levels as low as 0.005 percent by weight are effective to reduce both Cu and Pb corrosion in the HTCBT.

A, B, and C are as described previously. Molybdenum dithiocarbamate (D) is a commercial mixed tridecyl/2-ethylhexyl amine based molybdenum dithiocarbamate containing 10% molybdenum by weight available from Adeka Corporation. 1,2,4-Triazole (E) is 1-(N,N-bis(2-ethylhexyl) aminomethyl)-1,2,4-triazole from a different source compared to (C). Molybdenum dithiophosphate (F) is commercial molybdenum di(2-ethylhexyl)phosphorodithioate

TABLE 1

| | | Components (wt. %) | | | | | | | | | | | |
|---|---|---|---|---|---|---|---|---|---|---|---|---|---|
| | | Examples | | | | | | | | | | | |
| | | 1 Additive | | 2 Additives | | | | | | | 3 Additives | | |
| | | | | | | | | | | | A + | A + | A + |
| | | A 1A | B 1B | A + B 2A | A + C 2B | A + C 2C | A + C 2D | B + C 2E | B + C 2F | B + C 2G | B + C 3A | B + C 3B | B + C 3C |
| 1 | Base Blend* | 99.85 | 99.8125 | 99.835 | 99.845 | 99.84 | 99.8 | 99.81 | 99.805 | 99.765 | 99.83 | 99.825 | 99.785 |
| 2 | Molybdenum Dithio-carbamate (A) | 0.15 | — | 0.075 | 0.15 | 0.15 | 0.15 | — | — | — | 0.075 | 0.075 | 0.075 |
| 3 | Molybdenum Ester/Amide (B) | — | 0.1875 | 0.09 | — | — | — | 0.185 | 0.185 | 0.185 | 0.09 | 0.09 | 0.09 |
| 4 | 1,2,4 Triazole (C) | — | — | — | 0.005 | 0.01 | 0.05 | 0.005 | 0.01 | 0.05 | 0.005 | 0.01 | 0.05 |
| 5 | Total | 100 | 100 | 100 | 100 | 100 | 100 | 100 | 100 | 100 | 100 | 100 | 100 |
| 6 | Molybdenum (ppm) | 150 | 150 | 150 | 150 | 150 | 150 | 150 | 150 | 150 | 150 | 150 | 150 |
| 7 | Cu Run 1 | 10 | 46 | 55 | 6 | 6 | 440 | 10 | 7 | 400 | 7 | 7 | 6 |
| 8 | Cu Run 2 | 402 | 405 | 460 | 6 | 644 | 7 | 10 | 7 | 294 | 7 | 550 | 5 |
| 9 | Cu Run 3 | 72 | 172 | 116 | 62 | 50 | 5 | 35 | 7 | 8 | 33 | 11 | 5 |
| 10 | Avg. Cu (20 ppm max.) | 161.33 | 207.67 | 210.33 | 24.67 | 233.33 | 150.67 | 18.33 | 7.00 | 234.00 | 15.67 | 189.33 | 5.33 |
| 11 | Pb Run 1 | 46 | 144 | 72 | 44 | 8 | 16 | 126 | 130 | 20 | 56 | 63 | 65 |
| 12 | Pb Run 2 | 6 | 11 | 8 | 42 | 42 | 28 | 138 | 138 | 20 | 60 | 12 | 62 |
| 13 | Pb Run 3 | 44 | 140 | 70 | 36 | 16 | 30 | 167 | 118 | 96 | 70 | 65 | 54 |
| 14 | Avg. Pb (120 ppm max.) | 32.00 | 98.33 | 50.00 | 40.67 | 22.00 | 24.67 | 143.67 | 128.67 | 45.33 | 62.00 | 46.67 | 60.33 |
| 15 | ASTM D 6594 | Fail | Fail | Fail | Fail | Fail | Fail | Fail | Fail | Fail | Pass | Fail | Pass |
| 16 | Cu Run 1 | P | F | F | P | P | F | P | P | F | P | P | P |
| 17 | Cu Run 2 | F | F | F | P | F | P | P | P | F | P | F | P |
| 18 | Cu Run 3 | F | F | F | F | F | P | F | P | P | F | P | P |
| 19 | Pb Run 1 | P | F | P | P | P | P | F | F | P | P | P | P |
| 20 | Pb Run 2 | P | P | P | P | P | P | F | F | P | P | P | P |
| 21 | Pb Run 3 | P | F | P | P | P | P | F | F | P | P | P | P |
| 22 | Cu Pass (%) | 16.66% | | | | | 52.38% | | | | | 77.77% | |
| 23 | Pb Pass (%) | 66.66% | | | | | 71.42% | | | | | 100% | |

*Base Blend is fully formulated heavy duty diesel engine oil with SAE 15W40 viscosity grade

Examples 4 Thru 29

In Table 2-6, "base blend" is SAE 0W-20 viscosity grade fully formulated engine oil consisting of one or more base oils, dispersants, detergents, VI Improvers, antioxidants, antiwear agents, pour point depressants and any other additives such that when combined with the invention makes a fully formulated motor oil. Base blend is then further formulated as described in the examples shown in table 2-6.

Corrosivity of these formulations towards copper and lead metals was evaluated using high temperature corrosion bench test (HTCBT) according to the ASTM D 6594 test methods and modified HTCBT method. In the modified HTCBT method, The test lubricant was kept at 165° C. and dry air was bubbled through the lubricant at 5±0.5 L/h for 48 hours. After the test, the lubricants were analyzed for the Cu and Pb metal in the oil using inductive coupled plasma (ICP) analytical technique.

containing 8.5% molybdenum by weight available from Vanderbilt Chemicals, LLC. Molybdenum Trinuclear (G) is a trinuclear molybdenum dithiocarbamate containing 5.5% molybdenum by weight. Molybdenum dithiocarbamate (H) is a tridecyl amine based molybdenum dithiocarbamate containing 6.9% molybdenum by weight. N,N-Bis(2-ethylhexyl)-ar-methyl-1H-benzotriazole-1-methanamine (I) is an alkylamine derivative of tolutriazole corrosion inhibitor available from Vanderbilt Chemicals, LLC as CUVAN® 303. 2,5-dimercapto-1,3,4-thiadiazole derivative (J) is a sulfur-based corrosion inhibitor available from Vanderbilt Chemicals LLC as CUVAN® 826. In Tables 2 thru 6, the molybdenum content formulated into the lubricants is such that 160 ppm molybdenum is derived from the sulfur-free organo-molybdenum source (B) and approximately 160 ppm molybdenum is derived from a sulfur-containing molybdenum source.

Tables 2 thru 5 clearly show that the three-way combination of sulfur-free organomolybdenum (B), sulfur-containing organo-molybdenum (A, D, F, G, H) and 1,2,4-Triazole (C, E) are highly effective at reducing Cu and Pb corrosion in the HTCBT or modified HTCBT. Also, other corrosion inhibitors such as (I) and (J) are ineffective at simultaneously reducing both Cu and Pb corrosion in the HTCBT and modified HTCBT.

TABLE 2

| | | Examples | | | | |
|---|---|---|---|---|---|---|
| | | 4 | 5 | 6 | 7 | 8 |
| 1 | Base Blend* | 99.64 | 99.44 | 99.44 | 99.44 | 99.44 |
| 2 | Molybdenum Ester/Amide (B) | 0.2 | 0.2 | 0.2 | 0.2 | 0.2 |
| 3 | Molybdenum Dithiocarbamate (D) | 0.16 | 0.16 | 0.16 | 0.16 | 0.16 |
| 4 | 1,2,4-Triazole (C) | | 0.2 | | | |
| 5 | 1,2,4-Triazole (E) | | | 0.2 | | |
| 6 | N,N Bis(2-ethylhexyl)-ar-methyl-1H-benzotriazole-1-methanamine (I) | | | | 0.2 | |
| 7 | 2,5 dimercapto-1,3,4-thiadiazole derivative (J) | | | | | 0.2 |
| 8 | Total | 100 | 100 | 100 | 100 | 100 |
| 9 | Using ASTM D6594 | | | | | |
| 10 | Cu (20 ppm max.) Run 1 | 15 | 4 | 4 | 14 | 389 |
| 11 | Cu (20 ppm max.) Run 2 | 16 | 4 | 4 | 14 | 394 |
| 12 | Pb (120 ppm max.) Run 1 | 53 | 2 | 3 | 197 | 20 |
| 13 | Pb (120 ppm max.) Run 1 | 53 | 2 | 2 | 194 | 19 |
| 14 | Modified HTDBT Method | | | | | |
| 15 | Cu (20 ppm max.) Run 1 | 77 | 4 | 4 | 31 | 63 |
| 16 | Cu (20 ppm max.) Run 2 | 75 | 4 | 4 | 47 | 42 |
| 17 | Pb (120 ppm max.) Run 1 | 3 | 3 | 2 | 100 | 4 |
| 18 | Pb (120 ppm max.) Run 1 | 3 | 3 | 2 | 20 | 4 |

TABLE 3

| | | Examples | | | | |
|---|---|---|---|---|---|---|
| | | 9 | 10 | 11 | 12 | 13 |
| 1 | Base Blend* | 99.637 | 99.437 | 99.437 | 99.437 | 99.437 |
| 2 | Molybdenum Ester/Amide (B) | 0.2 | 0.2 | 0.2 | 0.2 | 0.2 |
| 3 | Molybdenum Dithiocarbamate (A) | 0.163 | 0.163 | 0.163 | 0.163 | 0.163 |
| 4 | 1,2,4-Triazole (C) | | 0.2 | | | |
| 5 | 1,2,4-Triazole (E) | | | 0.2 | | |
| 6 | N,N Bis(2-ethylhexyl)-ar-methyl-1H-benzotriazole-1-methanamine (I) | | | | 0.2 | |
| 7 | 2,5 dimercapto-1,3,4-thiadiazole derivative (J) | | | | | 0.2 |
| 8 | Total | 100 | 100 | 100 | 100 | 100 |
| | ASTM D6594 | | | | | |
| | Cu (20 ppm max.) Run 1 | 97 | 4 | 4 | 4 | 390 |
| | Cu (20 ppm max.) Run 2 | 101 | 4 | 12 | 2 | 366 |
| | Pb (120 ppm max.) Run 1 | 41 | 2 | <1 | 13 | 114 |
| | Pb (120 ppm max.) Run 2 | 52 | 1 | 224 | 190 | 102 |
| | Modified HTCBT Method | | | | | |
| | Cu (20 ppm max.) Run 1 | 164 | 6 | 4 | 26 | 50 |
| | Cu (20 ppm max.) Run 2 | 164 | 4 | 3 | 25 | 214 |
| 9 | Pb (120 ppm max.) Run 1 | 28 | 8 | 2 | 14 | 6 |
| 10 | Pb (120 ppm max.) Run 2 | 20 | 22 | 2 | 165 | 17 |

TABLE 4

| | | Examples | | | | |
|---|---|---|---|---|---|---|
| | | 14 | 15 | 16 | 17 | 18 |
| 1 | Base Blend* | 99.617 | 99.417 | 99.417 | 99.417 | 99.417 |
| 2 | Molybdenum Ester/Amide | 0.2 | 0.2 | 0.2 | 0.2 | 0.2 |

TABLE 4-continued

| | Examples | | | | |
|---|---|---|---|---|---|
| | 14 | 15 | 16 | 17 | 18 |
| (B) | | | | | |
| Molybdenum Dithiophosphate (F) | 0.183 | 0.183 | 0.183 | 0.183 | 0.183 |
| 1,2,4-Triazole (C) | | 0.2 | | | |
| 1,2,4-Triazole (E) | | | 0.2 | | |
| N,N Bis(2-ethylhexyl)-ar-methyl-1H-benzotriazole-1-methanamine (I) | | | | 0.2 | |
| 2,5 dimercapto-1,3,4-thiadiazole derivative (J) | | | | | 0.2 |
| Total | 100 | 100 | 100 | 100 | 100 |
| ASTM D 6594 | | | | | |
| Cu (20 ppm max.) Run 1 | 136 | 4 | 4 | 23 | 234 |
| Cu (20 ppm max.) Run 2 | 154 | 4 | 4 | 24 | 246 |
| Pb (120 ppm max.) Run 1 | 12 | 3 | 2 | 189 | 73 |
| Pb (120 ppm max.) Run 2 | 7 | 2 | 3 | 180 | 56 |
| Modified HTCBT Method | | | | | |
| Cu (20 ppm max.) Run 1 | 14 | 4 | 4 | 32 | 54 |
| Cu (20 ppm max.) Run 2 | 56 | 5 | 5 | 30 | 72 |
| Pb (120 ppm max.) Run 1 | 3 | 4 | 3 | 62 | 8 |
| Pb (120 ppm max.) Run 2 | 5 | 5 | 5 | 61 | 16 |

TABLE 5

| | Examples | | | | |
|---|---|---|---|---|---|
| | 19 | 20 | 21 | 22 | 23 |
| Base Blend* | 99.51 | 99.31 | 99.31 | 99.31 | 99.31 |
| Molybdenum Ester/Amide (B) | 0.2 | 0.2 | 0.2 | 0.2 | 0.2 |
| Molybdenum Tri-nuclear (G) | 0.29 | 0.29 | 0.29 | 0.29 | 0.29 |
| 1,2,4-Triazole (C) | | 0.2 | | | |
| 1,2,4-Triazole (E) | | | 0.2 | | |
| N,N Bis(2-ethylhexyl)-ar-methyl-1H-benzotriazole-1-methanamine (I) | | | | 0.2 | |
| 2,5 dimercapto-1,3,4-thiadiazole derivative (J) | | | | | 0.2 |
| Total | 100 | 100 | 100 | 100 | 100 |
| ASTM D 6594 | | | | | |
| Cu (20 ppm max.) Run 1 | 33 | 6 | 5 | 23 | 296 |
| Cu (20 ppm max.) Run 2 | 23 | 5 | 5 | 27 | 288 |
| Pb (120 ppm max.) Run 1 | 50 | 12 | 10 | 148 | 32 |
| Pb (120 ppm max.) Run 2 | 48 | 11 | 10 | 134 | 44 |
| Modified HTCBT Method | | | | | |
| Cu (20 ppm max.) Run 1 | 26 | 8 | 6 | 28 | 131 |
| Cu (20 ppm max.) Run 2 | 67 | 6 | 6 | 26 | 144 |
| Pb (120 ppm max.) Run 1 | 5 | 1 | 1 | 22 | 3 |
| Pb (120 ppm max.) Run 2 | 4 | 2 | 1 | 24 | 2 |

TABLE 6

| | Examples | | | | | |
|---|---|---|---|---|---|---|
| | 24 | 25 | 26 | 27 | 28 | 29 |
| Base Blend* | 100 | 99.565 | 99.365 | 99.365 | 99.365 | 99.365 |
| Molybdenum Ester/Amide (B) | | 0.2 | 0.2 | 0.2 | 0.2 | 0.2 |

TABLE 6-continued

| | Examples | | | | | |
|---|---|---|---|---|---|---|
| | 24 | 25 | 26 | 27 | 28 | 29 |
| Molybdenum Dithiocarbamate (H) | | 0.235 | 0.235 | 0.235 | 0.235 | 0.235 |
| 1,2,4-Triazole (C) | | | 0.2 | | | |
| 1,2,4-Triazole (E) | | | | 0.2 | | |
| N,N Bis(2-ethylhexyl)-ar-methyl-1H-benzotriazole-1-methanamine (I) | | | | | 0.2 | |
| 2,5 dimercapto-1,3,4-thiadiazole derivative (J) | | | | | | 0.2 |
| Total | 100 | 100 | 100 | 100 | 100 | 100 |
| ASTM D 6594 | | | | | | |
| Cu (20 ppm max.) Run 1 | 5 | 14 | 4 | 5 | 22 | 374 |
| Cu (20 ppm max.) Run 2 | 4 | 12 | 4 | 5 | 15 | 347 |
| Pb (120 ppm max.) Run 1 | 2 | 66 | 11 | 10 | 260 | 4 |
| Pb (120 ppm max.) Run 2 | 3 | 74 | 13 | 8 | 267 | 22 |
| Modified HTCBT Method | | | | | | |
| Cu (20 ppm max.) Run 1 | 71 | 64 | 4 | 4 | 31 | 41 |
| Cu (20 ppm max.) Run 2 | 5 | 44 | 4 | 4 | 32 | 33 |
| Pb (120 ppm max.) Run 1 | 2 | 4 | 3 | 4 | 62 | 4 |
| Pb (120 ppm max.) Run 2 | 1 | 14 | 6 | 4 | 64 | 4 |

Examples 30 Thru 33

In Table 7, "base blend" is SAE 15W-40 viscosity grade fully formulated heavy duty diesel engine oil consisting of one or more base oils, dispersants, detergents, VI Improvers, antioxidants, antiwear agents, pour point depressants and any other additives such that when combined with the invention makes a fully formulated motor oil. Base blend is then further formulated as described in the examples 30-33.

Corrosivity of these formulations towards copper and lead metals was evaluated using high temperature corrosion bench test (HTCBT) according to the ASTM D 6594 test methods. Details of the test method can be found in the annual book of ASTM standards. For the test specimen 100±2 grams of lubricant was used. Four metal specimens of copper, lead, tin and phosphor bronze were immersed in a test lubricant. The test lubricant was kept at 135° C. and dry air was bubbled through at 5±0.5 L/h for 1 week. API CJ-4 specifications for heavy duty diesel engine oil limits the metal concentration of copper and lead in the oxidized oil as per ASTM D 6594 test methods to 20 ppm maximum and 120 ppm maximum respectively. After the test, lubricant were analyzed for the Cu and Pb metal in the oil using inductive coupled plasma (ICP) analytical technique.

A, B and C are as described previously. Dioctylated diphenylamine derivative of 1,2,4-triazole (P-1) was that prepared in Example P-1. Butylated/octylated diphenylamine derivative of 1,2,4-triazole (P-2) was that prepared in example P-2.

TABLE 7

| | 30 | 31 | 32 | 33 |
|---|---|---|---|---|
| Commercial 15W40 oil | 99.64 | 99.44 | 99.24 | 99.24 |
| Molybdenum dithiocarbamate (A) | 0.16 | 0.16 | 0.16 | 0.16 |
| Molybdenum ester/amide (B) | 0.2 | 0.2 | 0.2 | 0.2 |
| 1,2,4-triazole (C) | | 0.2 | | |
| Dioctylated diphenylamine derivative of 1,2,4-triazole (50% active) (P-1) | | | 0.4 | |

TABLE 7-continued

| | 30 | 31 | 32 | 33 |
|---|---|---|---|---|
| Butylated/octylated diphenylamine derivative of 1,2,4-triazole (50% active) (P-2) | | | | 0.4 |
| Total | 100 | 100 | 100 | 100 |
| Mo (ppm) | 320 | 320 | 320 | 320 |
| ASTM D6594 | | | | |
| Cu (20 ppm Max.) Run 1 | 225 | 7 | 51 | 8 |
| Cu (20 ppm Max.) Run 2 | 265 | 6 | 48 | 7 |
| Pb (120 ppm Max.) Run 1 | 101 | 47 | 67 | 40 |
| Pb (120 ppm Max.) Run 2 | 116 | 43 | 99 | 50 |

The results clearly show that that 1,2,4-triazole (C), dioctylated diphenylamine derivative of 1,2,4-triazole (50% active) (P-1), and butylated/octylated diphenylamine derivative of 1,2,4-triazole (P-2) are all effective to reduce corrosion in the three-way additive system containing sulfur-free organo-molybdenum, sulfur-containing organo-molybdenum and derivatized triazole.

Example P-1

Preparation of 1-(N,N-bis(4-(1,1,3,3-tetramethylbutyl)phenyl)aminomethyl)-1,2,4-triazole in 50% process oil In a 500 mL three-necked round bottom flask equipped with a temperature probe, overhead stirrer and Dean Stark set up were charged VANLUBE® 81 (dioctyl diphenylamine) (62.5 g, 0.158 mole), 1,2,4-triazole (11.0 g, 0.158 mole), paraformaldehyde (5.5 g, 0.158 mole), water (3 g, 0.166 mole) and process oil (37.7 g). The mixture was heated under nitrogen to 100-105° C. with rapid mixing. Mixing was continued at 100° C. for one hour. After one hour, water aspirator vacuum was applied and the reaction temperature was raised to 120° C. The reaction mixture was held at this temperature for an hour. The expected amount of water was recovered, suggesting a complete reaction occurred. The reaction mixture was allowed to cool to 90° C., and transferred to a container. A light amber liquid (102.93 g) was isolated.

Example P-2

Preparation of Mixed Butylated/Octylated Diphenylamine Derivative of 1,2,4-Triazole in 50% Process Oil In a 500 mL three-necked round bottom flask equipped with a temperature probe, overhead stirrer and Dean Stark set up were charged VANLUBE® 961 (mixed butylated/octylated diphenylamine) (60 g, 0.201 mole), 1,2,4-triazole (13.9 g, 0.200 mole), paraformaldehyde (6.8 g, 0.207 mole), water (3.8 g, 0.208 mole) and process oil (77 g). The mixture was heated under nitrogen to 100-105° C. with rapid mixing. Mixing was continued at 100° C. for one hour. After one hour, water aspirator vacuum was applied and the reaction temperature was raised to 120° C. The reaction mixture was held at this temperature for an hour. The expected amount of water was recovered, suggesting a complete reaction occurred. The reaction mixture was allowed to cool to 90° C., and transferred to a container. A dark amber liquid (138.86 g) was isolated.

What is claimed is:

1. A lubricating composition for reducing copper and/or lead corrosion, comprising a lubricant base, and an additive composition comprising (A) a sulfur-free organo-molybdenum compound being a molybdenum ester/amide complex, (B) a sulfur-containing organo-molybdenum compound and (C) a triazole derivative prepared by reacting 1,2,4-triazole, a formaldehyde source and an amine, the triazole derivative selected from an alkylated diphenylamine derivative of triazole and an alkylamine derivative of triazole; wherein the ratio of (A):(B) based on molybdenum content is from about 0.5:1 to 2:1 and the total molybdenum content from (A) and (B) is about 75 ppm to about 320 ppm, and (C) the triazole derivative is present in an amount from about 0.005-0.4% by weight of the lubricating composition.

2. The lubricating composition according to claim 1, wherein the total molybdenum content is about 160 ppm to 320 ppm.

3. The lubricating composition according to claim 1, wherein the ratio of (A):(B) based on molybdenum content is about 1:1.

4. The lubricating composition according to claim 1 wherein the triazole derivative is an alkylated diphenylamine derivative of triazole selected from mono-butylated diphenylamine derivative of triazole, di-butylated diphenylamine derivative of triazole, mono-butylated mono-octylated diphenylamine derivative of triazole, mono-octylated diphenylamine derivative of triazole, di-octylated diphenylamine derivative of triazole and di-nonylated diphenylamine derivative of triazole.

5. The lubricating composition according to claim 1 wherein the triazole derivative is an alkylamine derivative of triazole being a bis(alkyl)aminomethyl derivative of triazole.

6. The lubricating composition according to claim 5 wherein the alkylamine derivative of triazole is 1-(N,N-bis(2-ethylhexyl)aminomethyl)-1,2,4-triazole.

7. The lubricating composition according to claim 1 wherein the sulfur-containing molybdenum source is selected from molybdenum dithiophosphate, molybdenum dithiocarbamate and a trinuclear molybdenum dithiocarbamate.

8. The lubricating composition according to claim 1, wherein the reduction of copper and/or lead corrosion is according to the High Temperature Corrosion Bench Test ASTM D 6594.

9. The lubricating composition of claim 1, wherein the lubricating oil is one that is determined to be corrosive to Cu and/or Pb according to the High Temperature Corrosion Bench Test ASTM D 6594 when at least one of A, B or C are not present.

10. A method of reducing high temperature corrosion in heavy duty diesel engines, comprising the steps of:

(1) determining whether a heavy duty diesel engine oil is corrosive to Cu and/or Pb according to the High Temperature Corrosion Bench Test ASTM D 6594 when at least one of the following are not present in the engine oil:

(A) a sulfur-free organo-molybdenum source, (B) a sulfur-containing organo-molybdenum source, and (C) a triazole derivative prepared from 1,2,4-triazole, a formaldehyde source and an amine source; and (2) if the engine oil is determined to be corrosive according to step (1), adding to the engine oil one or more of components (A), (B) and (C) such that the total amount of components are as present in claim 1.

11. The lubricating composition according to claim 4, wherein the alkylated diphenylamine derivative of triazole is selected from butylated/octylated diphenylamine derivative of triazole and di-octylated diphenylamine derivative of triazole.

12. The lubricating composition according to claim 11, wherein the ratio of (A):(B) based on molybdenum content is about 1:1.

13. The lubricating composition according to claim 6, wherein the ratio of (A):(B) based on molybdenum content is about 1:1.

* * * * *